United States Patent [19]

Mason

[11] 3,939,619

[45] Feb. 24, 1976

[54] FACING WALL CONSTRUCTION

[75] Inventor: Richard Bell Mason, Cherry Hill, N.J.

[73] Assignee: Johns-Manville Corporation, Denver, Colo.

[22] Filed: Apr. 19, 1974

[21] Appl. No.: 462,474

Related U.S. Application Data

[63] Continuation of Ser. No. 166,237, July 26, 1971, abandoned, which is a continuation of Ser. No. 846,830, Aug. 1, 1969, abandoned.

[52] U.S. Cl. ..... 52/509; 52/562; 52/714

[51] Int. Cl.[2] ..... E04B 1/38

[58] Field of Search ..... 52/428, 489, 509, 513, 52/562–564, 712, 714

[56] References Cited

UNITED STATES PATENTS

| | | | |
|---|---|---|---|
| 360,625 | 4/1887 | Snell | 52/513 X |
| 555,358 | 2/1896 | Balsley | 52/509 |
| 960,043 | 5/1910 | Selden | 52/428 |
| 1,803,141 | 4/1931 | Paulissen | 52/714 |
| 2,043,440 | 6/1936 | Littlefield | 52/509 |
| 2,056,328 | 10/1936 | Price | 52/489 X |
| 2,060,045 | 11/1936 | Davidson | 52/562 |
| 2,083,725 | 6/1937 | Manske et al. | 52/489 |
| 2,317,428 | 4/1943 | Anderson | 52/509 |
| 2,320,480 | 6/1943 | Stagg | 52/513 X |
| 3,225,504 | 12/1965 | Gregoire | 52/509 |

FOREIGN PATENTS OR APPLICATIONS

| | | | |
|---|---|---|---|
| 125,336 | 9/1947 | Australia | 52/564 |

*Primary Examiner*—Alfred C. Perham
*Attorney, Agent, or Firm*—Robert M. Krone; James W. McClain

[57] ABSTRACT

A portion of a clip fits into the cavity of a hollow core panel and another portion is attached to a structural wall. The portion inside the cavity has normally tapered opposed walls which are straightened, upon insertion into the cavity, to form parallel walls engaging the interior panel surfaces forming the cavity, thus providing a secure fit.

3 Claims, 5 Drawing Figures

Fig. 1.
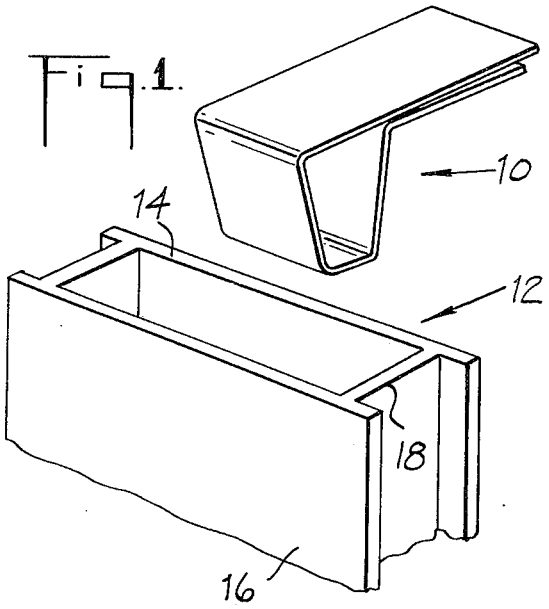
Fig. 2.
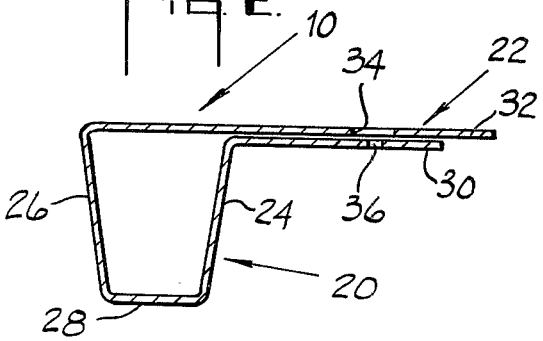
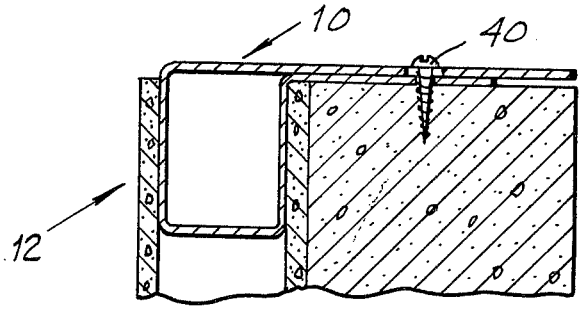
Fig. 3.
Fig. 4.
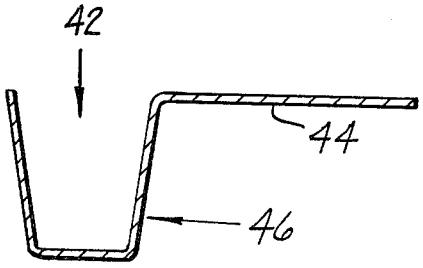
Fig. 5.
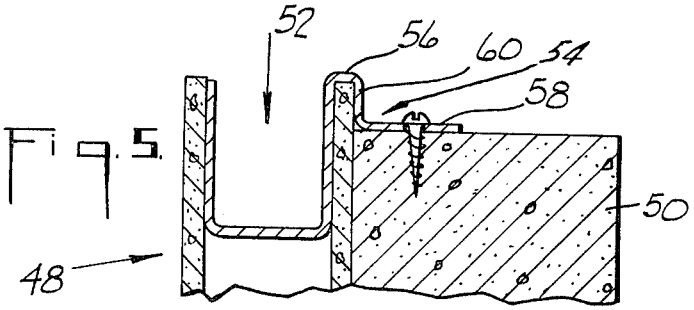
INVENTOR.
RICHARD BELL MASON
BY John A. McKinney
ATTORNEY

FACING WALL CONSTRUCTION

This is a continuation of application Ser. No. 166,237, filed July 26, 1971, now abandoned; which is a continuation of application Ser. No. 846,830, filed Aug. 1, 1969, and now abandoned.

BACKGROUND OF THE INVENTION

This invention relates broadly to means for securing facing panels to a building. In particular, it relates to the mechanical fastening of hollow core panels to a building structure, with the fastening means being hidden from view.

Hollow core panels are finding increasing use as architectural panels. Often formed of cast concrete or extruded cement, their exposed faces can be textured to resemble bulky stone panels or provided with ribs or other types of surface treatment to give a highly pleasing architectural effect. The benefit of the hollow construction is that it enables the panels to have a desirable bulky appearance and adequate strength without being too heavy to be readily handled and installed.

The main problem to be overcome with such a panel is the difficulty of securely and rapidly attaching it to a building wall so that no fasteners are visible. Since the time required for installation is a major item in the cost of a structure, it is highly important that workmen be able to simply and easily install the panels.

OBJECTS OF THE INVENTION

The main object of the invention is to provide a simple panel securing arrangement which securely holds a hollow panel to a structural wall and which permits rapid installation.

SUMMARY OF THE INVENTION

The foregoing object is met by the fastening arrangement of this invention which comprises a clip that has a cup portion inserted in the cavity of a hollow core panel adjacent the horizontal edge of the panel, and an arm extending from the cup portion which is attached to the structural wall. The cup portion of the clip is formed by two oppositely facing side walls which engage the interior panel wall surfaces forming the cavity, and a bottom wall connecting the ends of the side walls remote from the horizontal edge of the panel. The side walls of the cup portion, at least adjacent the horizontal edge of the panel, are biased toward and into engagement with the interior wall surfaces to hold the panel securely in place.

DESCRIPTION OF DRAWINGS

The nature of the invention will be more fully understood and other objects may become apparent when the following detailed description is considered in connection with the accompanying drawing, wherein:

FIG. 1 is a pictorial representation of a fastening clip of the invention and a partial pictorial representation of an illustrative panel with which the clip can be used;

FIG. 2 is a sectional view of the clip of FIG. 1 shown as having aligned holes for receiving a fastener;

FIG. 3 is a partial cross-sectional view of a panel held in place by a clip;

FIG. 4 is a sectional view of a modified clip; and

FIG. 5 is a view similar to that of FIG. 3, but showing a further modified arrangement.

DETAILED DESCRIPTION OF THE INVENTION

Referring to FIG. 1, a clip 10 is shown adjacent a hollow core panel 12 having faces 14 and 16 connected by webs 18. The panel is illustrated as an extruded cementitious panel, although obviously the panel can take other specific shapes and be formed by other methods. The clip 10 is for the purpose of engaging the hollow core portion of the panel, without being visible in the final installation, and securing it to the face of a structural wall.

As shown in FIG. 2, the clip is comprised of an integral strip bent across its width at several locations to form a cup-like configuration 20 and an upper lateral extension 22. Forming the cup-like configuration are side walls 24 and 26 connected at their lower extremities by bottom wall 28. Extending laterally from the upper extremity of side wall 24 is arm 30, and overlying arm 30 is arm 32 which extends laterally from the upper extremity of the far side wall 26, both of which arms together form the extension 22. The side walls 24 and 26 converge slightly toward the bottom wall 28 to permit the cup portion to be readily inserted into the cavity of a hollow core panel. If desired, apertures may be formed in the arms forming the extension 22 for receiving a bolt or other fastener. The dotted lines at 34 in arm 32 indicate a slot and the dotted lines at 36 indicate a circular aperture. When apertures are provided the slot is necessary for alignment purposes because the arms slide relative to each other when the cup portion of the clip is inserted into a hollow panel the inside thickness of which is slightly less than the width of the upper extremity of the cup portion 20. The arm 30 in such case moves toward the left and the arm 32 moves toward the right, when viewed as in FIG. 2.

FIG. 3 shows the clip 10 attached to a structural wall 38 by bolt 40 and holding the panel 12 in place against the wall. The cup portion of the clip is fitted in the hollow core of the panel, the inside width of which is slightly less than the width of the upper or widest part of the cup portion, resulting in a force fit. This tapered clip construction simplifies the insertion of the clip into the hollow core of the panel, the narrower leading edge of the cup portion guiding the movement of the clip, and provides a secure connection between the panel and the structural wall. The force fit does not permit relative sideward movement between the panel and the installed clip.

A modified clip 42, shown in FIG. 4, has an arm 44 and a cup portion 46 but does not have an arm corresponding to arm 32 of clip 10. With this arrangement the clip performs the same function as clip 10 but is less costly due to the absence of a second lateral arm. This would not be used where maximum holding power is required because the construction is not as sturdy as the clip 10. As illustrated, arm 44 does not have an aperture for receiving a fastener. In such case a rivet or other propelled fastener would be used to pierce both the clip arm and the structural wall. It should be understood that a solid arm or lateral extension can also be provided with the embodiment of clip 10.

Another embodiment is shown in FIG. 5 wherein the panel 48 extends above the structural wall 50. The clip 52 is similar to the clip 42 of FIG. 4, but the arm 54 of the clip is comprised of three sections. Section 56 extends from the cup portion in the usual manner and is connected to the parallel, displaced section 58 by section 60 which extends from the far extremity of section 56 to the near extremity of section 58 at generally right angles to both.

The clip can be formed of any suitable strong material which permits the tapered wall construction of the cup section to be forced inwardly to assume a parallel wall construction and thus exert an outward biasing force tending to move the walls back to their original tapered or converging position. An example is an 18 gauge steel strip bent at suitable locations to form the configurations shown in the drawing. It should be understood that the clip can be inserted either at the top or bottom of the hollow panel, whichever is most convenient, depending upon the construction of the structural wall.

What is claimed is:

1. In a facing panel installation in which a hollow core panel is attached to a building structure, the panel having an opening extending substantially throughout the vertical extent of the panel, the improvement comprising:

a. a clip having a cup portion inserted in said opening of the hollow core panel adjacent a horizontal edge of the panel, b. the cup portion having two oppositely facing side walls, each of which engages one of the interior panel wall surfaces forming the opening, and a bottom wall connecting the ends of the side walls remote from the horizontal edge of the panel, c. the cup portion of the clip normally being of tapered shape with the ends of the side walls remote from the bottom wall being spaced farther apart than the ends of the side walls connected to the bottom wall, and the distance between the interior panel wall surfaces forming the opening being slightly less than the maximum spacing of the side walls of the cup portion in normal unstressed condition, whereby the said ends of the side walls remote from the bottom wall are forced toward each other by the interior panel wall surfaces upon insertion of the cup portion into the opening of the hollow core panel, d. extension means connected to the other ends of the side walls of the cup portion of the clip and attached to the structural wall, said extension means comprising two laterally extending arms connected to the side walls of the cup portion of said clip, and e. the side walls of the cup portion, at least adjacent to the horizontal edge of the panel, being biased away from each other toward and into engagement with the interior wall surfaces forming the opening of the hollow core panel.

2. A facing panel installation as recited in claim 1, wherein the extension means is attached to the building structure by fastening means extending through apertures in the extension.

3. A facing panel installation as recited in claim 1, wherein each of said walls and extensions comprising said clip is substantially wider than it is thick.

* * * * *